US005220382A

United States Patent [19]

Hediger

[11] Patent Number: 5,220,382

[45] Date of Patent: Jun. 15, 1993

[54] DEVELOPMENT APPARATUS HAVING A CROSS-MIXING AUGER

[75] Inventor: Edwin A. Hediger, Fairport, N.Y.

[73] Assignee: Eastman Kodak Company, Rochester, N.Y.

[21] Appl. No.: 812,141

[22] Filed: Dec. 23, 1991

[51] Int. Cl.[5] ..... G03G 15/06

[52] U.S. Cl. ..... 355/245; 118/653; 366/297; 366/329

[58] Field of Search ..... 118/612, 653, 656, 657, 118/658; 355/245, 251, 253; 366/291, 297, 300, 301, 315, 316, 317, 343, 319, 329

[56] References Cited

U.S. PATENT DOCUMENTS

| | | | |
|---|---|---|---|
| 3,730,487 | 5/1973 | Lund | 366/291 X |
| 4,577,587 | 3/1986 | Kamezaki | 355/253 X |
| 4,723,143 | 2/1988 | Enomoto | 355/253 |
| 4,855,783 | 8/1989 | Takashima et al. | 355/245 X |
| 4,974,023 | 11/1990 | Aimoto et al. | 355/245 |
| 4,980,724 | 12/1990 | Tanaka | 355/245 |
| 5,025,287 | 6/1991 | Hilbert | 355/245 |
| 5,151,739 | 9/1992 | Hediger | 355/245 |

*Primary Examiner*—A. T. Grimley
*Assistant Examiner*—Robert Beatty
*Attorney, Agent, or Firm*—Tallam I. Nguti

[57] ABSTRACT

A dual auger development apparatus for use in an electrostatographic reproduction machine such as copier or printer, includes a pair of identical single piece auger devices and each having a shaft and a plurality of integrally formed partial blade members so as to require no assembly of the blades to the shaft. Each auger device includes a radially extending cross-mixing vane which is integrally formed on the shaft. The cross-mixing vane formed as such is spaced circumferentially from the edges of the partial blades and extends continuously the full length of the shaft within the development housing. The cross-mixing vane includes a first length portion and a second length portion, The first length portion has a radial extension that is coextensive with that of the blade members and which is greater than that of the second length portion.

6 Claims, 3 Drawing Sheets

DEVELOPMENT APPARATUS HAVING A CROSS-MIXING AUGER

CROSS-REFERENCE TO A RELATED APPLICATION

This application is related to U.S. application Ser. No. 07/737,304, now U.S. Pat. No. 5,151,739 filed Jul. 29, 1991 in the name of Edwin A. Hediger and entitled "DEVELOPMENT APPARATUS AND IMPROVED AUGER DEVICE FOR USE THEREIN."

BACKGROUND OF THE INVENTION

1. Technical Field

This invention relates to development apparatus in electrostatographic reproduction machines such as copiers and printers for electrostatically developing latent images with developer material. More particularly, this invention relates to such a development apparatus that includes a cross-mixing auger device for improved mixing and charging of the developer material.

2. Background Art

It is well known to use toner particles stored within a development apparatus in an electrostatographic reproduction machine, such as a copier or printer, to develop electrostatically formed latent images on an image-bearing member. The toner particles may be stored as such alone or as a component of a two-component developer material, the second component being magnetic carrier particles.

Typically, the development apparatus so used is elongate front-to-back, and is utilized to store, move and mix the developer material. Where two component developer material is employed, moving, mixing and feeding the developer material as such, triboelectrically and appropriately charges the toner and carrier particles therein. The development apparatus also brings the developer material into applying relationship with the images to be developed so that the charged toner particles contained in such developer material are attracted to such images. Such development apparatus are disclosed, for example, in U.S. Pat. Nos. 4,974,023 issued Nov. 27, 1990 to Aimoto et al, and 4,980,724 issued Dec. 25, 1990 to Tanaka. As disclosed, these development apparatus include auger-type mixing devices which are assembled and which have full circumferentially extending blades. The blades are interconnected with longitudinally extending interblade vanes for cross-mixing. Unfortunately, such interblade connecting vanes have a uniform radial extension and are likely to create corner pockets with the blades which can trap developer material thus resulting in mixing inefficiency.

The quality of images developed with charged toner particles as above, depends significantly on the effectiveness and reliability of the development apparatus in triboelectrically charging the toner and carrier particles, and in consistently maintaining desirably high end to end concentration levels of toner particles even when new toner particles are replenished or added at one of such ends. As such, improvements in devices for moving and mixing developer material are very important with respect to improving the quality and reliability of electrostatographic image development. Mixing inefficiency as described above is therefore likely to detrimentally affect image development quality.

SUMMARY OF THE INVENTION

In accordance with the present invention, a development apparatus is provided for use in an electrostatographic reproduction machine to move, mix and triboelectrically charge developer material. The development apparatus includes a single piece auger device which comprises a rigid round shaft having first and second ends for mounting in the development apparatus housing. The single piece auger device also comprises a plurality of radially extending blade members which are spaced axially on the shaft and are each slanted relative to the axis of the shaft. The blade members are formed integrally with the shaft so as to require no blade-member-to-shaft assembly. The single piece auger device further comprises a radially extending full length cross-mixing vane that is formed integrally with the shaft. The full length cross-mixing vane is formed on the shaft so as to be spaced circumferentially from the edges of the blade members, and so as to include a first length portion of a first radial extension and a stepped second length portion of a second and greater radial extension controlled variable cross-mixing of developer material.

BRIEF DESCRIPTION OF THE DRAWINGS

In the description of the invention presented below, reference is made to the drawings in which.

DETAILED DESCRIPTION OF THE PREFERRED EMBODIMENT

Because electrostatographic reproduction apparatus or machines and development apparatus for use therein are well known, the present description will be directed in particular to elements forming part of or cooperating more directly with the present invention. Elements not specifically shown or described herein are assumed selectable from those known in the prior art.

Figure 1:
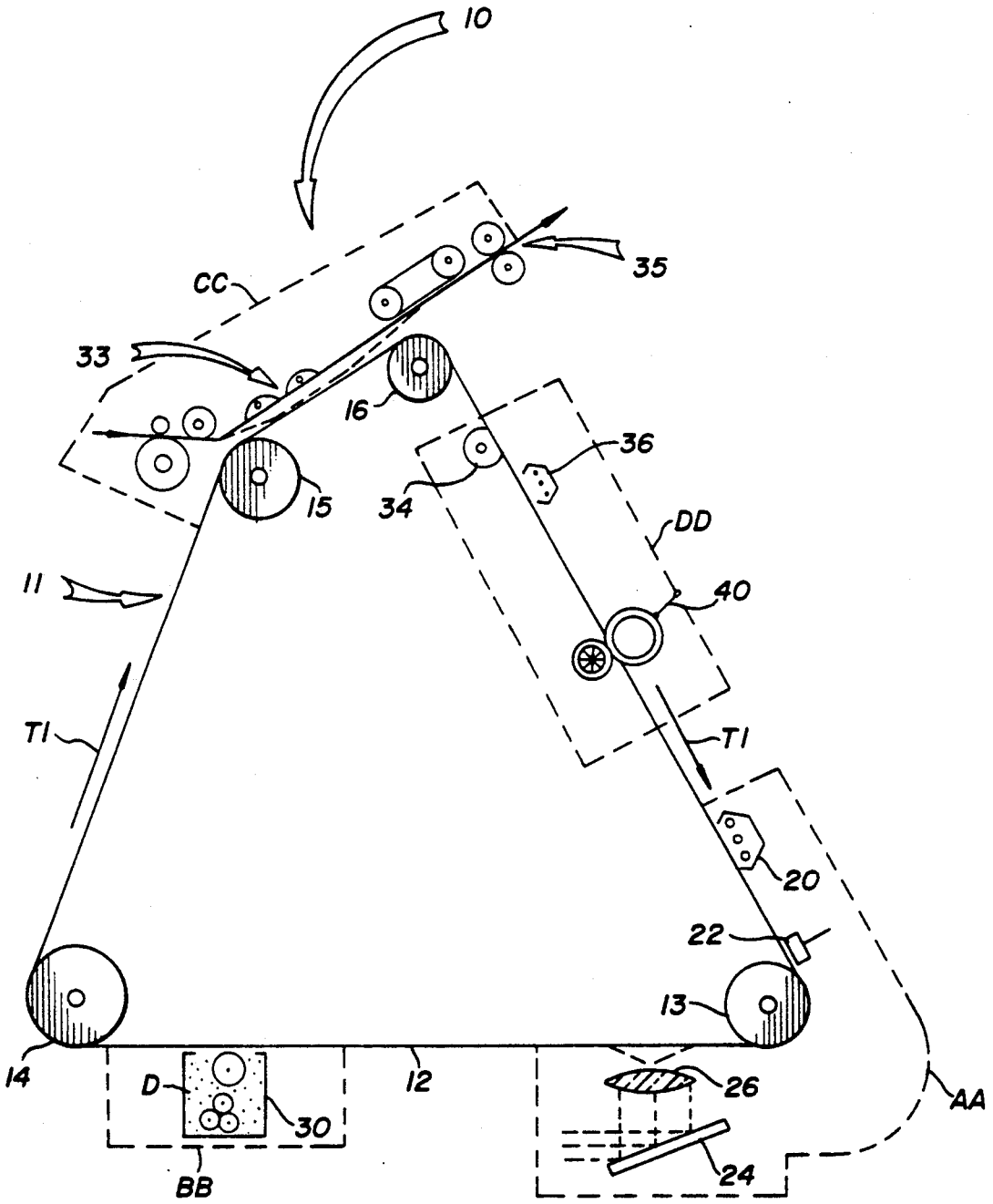
FIG. 1 is a schematic of an electrostatographic reproduction machine such as a copier or printer including the development apparatus of the present invention.

Referring now to FIG. 1, an electrostatographic reproduction apparatus or machine such as an optical copier is shown generally as 10. The apparatus 10, as shown, includes an image-bearing member 11 which is an endless flexible photoconductive belt that has a frontside image-bearing surface 12. Although the member 11 is shown as an endless flexible web trained about the series of rollers 13–16, it should be understood that an image-bearing member in the form of a rigid drum can also be used. The member 11, as shown, is trained about the series of rollers 13–16 for movement in the direction, for example, of the arrow T1. One of the rollers, such as the roller 13, can be a drive roller for repeatedly moving the member 11 through a series of electrostatographic process stages shown, for example, as AA, BB, CC and DD.

As shown in FIG. 1, clean and charge-free portions of the image-bearing member 11 initially move through the stage AA where electrostatic charges and/or light, are used in one manner or another (as is well known in the art) to electrostatically form, on the surface 12, latent images of an original document. Typically, the stage AA includes components such as a primary charger 20 or other charge depositing component (not shown). The latent image of an original can thus be formed electrostatically on the image-bearing surface 12, for example, by first uniformly charging the surface 12 to a suitable potential using the primary charger 20, and then imagewise discharging portions of such surface using, for example, an electronic printhead 22 or the like, and/or an optical system as shown partially. A typical optical system includes a light source (not shown) that illuminates a document sheet. The light rays reflected by a mirror such as 24 can then be reflected through a lens 26, and onto the surface 12 for such optical imaging.

The imaged portion of the image-bearing surface 12 of member 11 next moves to the stage BB where the latent image thereon is developed, that is, made visible, with charged particles of toner. Stage BB therefore includes a development apparatus, such as the development apparatus of the present invention, shown generally as 30. The development apparatus 30 of the present invention (to be described in detail below) contains magnetic developer material D, for example a two-component magnetic developer material that is comprised of magnetic carrier particles and charged toner particles. The magnetic developer material is used therein for developing the latent images on the surface 12 of member 11. During such image development, the charged toner particles in the developer material D transfer to the image-bearing surface 12, and adhere to the latent electrostatically formed image thereon, thereby making the image visible.

After such development, the portion of the image-bearing member 11 carrying the toner image thereon then moves to the stage CC. The stage CC, as shown, includes an image transfer station 33 where the visible toner image on the surface 12 is transferred to a suitable receiver sheet, such as a sheet of plain paper, which is fed in registration to the station 33 along a sheet travel path. After such image transfer, the copy sheet then travels to a fusing station 35, as shown, where the toner image is permanently fused to the receiver sheet to form a hard copy.

Meanwhile, the used portion of member 11, from which the toner image was transferred, moves on towards the initial stage AA to again begin another imaging cycle. To ensure continued production of high quality hard copies during subsequent cycles of the above imaging process, each such used portion of the surface 12 must be cleaned before it is again reused. Such cleaning effectively removes any residual charges and residual particles remaining on the surface 12 following image transfer. Accordingly, such cleaning is carried out at the stage DD where residual charges are removed by a discharge lamp 34 and/or neutralized by a corona charger 36, for example, and residual particles are removed by a cleaning apparatus shown, for example, as 40.

Figure 2:
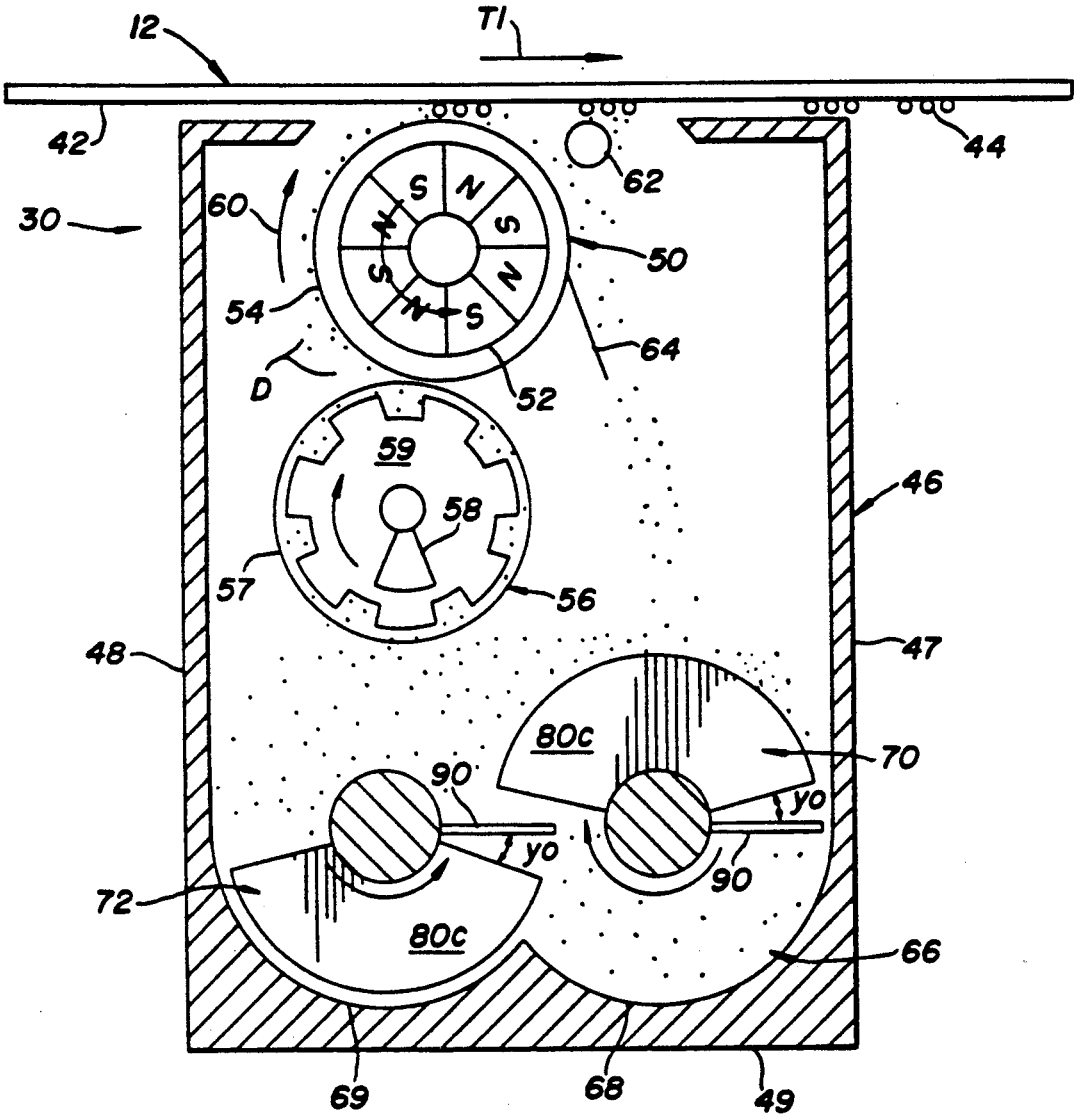
FIG. 2 is an enlarged end section of the development apparatus of FIG. 1 incorporating the single piece auger device and the full-length cross-mixing vane of the present invention.

Referring now to FIG. 2 of the drawings, the development apparatus of the present invention is generally designated 30. Development apparatus 30 is adapted to store, mix and supply a quantity of marking particles, such as charged toner particles contained in the magnetic developer material D, for developing latent electrostatographic images 42 formed as above on the image-bearing surface 12 of the image-bearing member 11. During development, the charged toner particles in the magnetic development material D are attracted to electrostatic latent images 42, thus forming toner or developed images illustrated as 44.

The development apparatus 30 has an elongate housing 46 which includes a top wall having an opening therein, upright end walls (not shown), first and second side walls 47, 48 and a bottom wall 49. A magnetic development roller 50 located in the upper portion of housing 46 extends substantially the entire length (end wall-to-end wall) of the housing. The development roller 50 is located within the housing 46 so that it is within the opening in the top wall, and so that it projects slightly therethrough. The development apparatus 30 is mounted within the copier or printer 10 (FIG. 1) so that the development roller 50 is adjacent and spaced only a small distance from the image-bearing surface 12 of the member 11. The development roller 50 preferably includes a magnetic core 52 comprised of a series of longitudinally extending, alternating N and S pole magnets arranged as shown. The core 52 is supported at its ends by conventional means, and is driven rotatably, for example, in the counterclockwise direction by a drive motor (not shown). The development roller 50 also includes a non-magnetic shell 54 that may be concentric with the core 52, and that is similarly supported. As such, the shell 54 may be stationary or also rotatable.

The development apparatus 30 further includes a feed roller 56 located below the development roller 50 for feeding developer material D onto the surface of the non-magnetic shell 54. The feed roller 56 includes a stationary shell 57 and a stationary magnet 58 for attracting magnetic developer material into roller 56 through a first opening at the bottom thereof for movement mechanically therewithin by a rotatable fluted core 59. The developer material moved thus is attracted out of the feed roller 56 through another opening at the top thereof and onto the surface of the shell 54 by the magnetic influence of the core 52. Appropriate rotation of the core 52 and shell 54 of the development roller 50 as is well known will then move the developer material D attracted thereonto, in the direction of the arrow 60 for electrostatically developing the images 42 on the surface 12.

During such image development, appropriately charged toner particles, contained in a development zone together with oppositely charged magnetic carrier particles in the developer material D, are desirably attracted onto the latent electrostatic images 42 on the surface 12 thereby forming the toner or developed images 44. The toner images 44 subsequently can be transferred, if necessary, onto a suitable receiver for fusing in order to form a fused or permanent copy thereof.

To improve the quality of such a fused copy, the development apparatus 30 includes a scavenging device 62 for recovering, from the image-bearing surface 12, any charged magnetic carrier particles undesirably also attracted to the latent images 42 during image development, as above. The development apparatus 30 also includes a skive mechanism 64 for removing spent developer material from the development roller 50 before it again attracts fresh developer from the feed roller 56 for subsequent image development.

The quality of image development with charged toner particles, as above, depends even more significantly on a number of factors, including particularly the charge values or levels of the toner and carrier particles of the developer material D, as well as, on the level and uniformity of the concentration of such charged toner particles available throughout the elongate development apparatus. As is well known, these quality factors are directly determined by the ability and effectiveness of the development apparatus 30 (i) to cause desirable triboelectric charging of the toner and carrier particles by moving and mixing the developer material, and (ii) to achieve and maintain even front-to-back, and side-to-side movement, mixing, and accumulation of developer material within the sump portion thereof.

Such ability and effectiveness of the development apparatus 30 should hold true even when, given the depletion of toner particles through image development, fresh toner particles are occasionally added thereto, for example, to the center or at one end of the sump portion. Following such addition, the fresh toner particles must of course be quickly and effectively moved and mixed with the low toner concentration developer material therein, in order to quickly achieve desirable high and uniform toner particle charge and concentration levels throughout the elongate development apparatus. Such levels, as is well known, are very necessary for high and reliable quality image development.

Accordingly for achieving such high and reliable quality image development, the development apparatus 30 includes a sump portion 66 consisting of a pair of side-by-side, parallel, recessed cylindrical sections 68 and 69 for holding a supply of developer material D. The sump sections 68, 69 are located so that they partially form an overlapping segment therebetween that has a very low bottom intersection point as close as possible to bottom of the sump 66.

The development apparatus 30 then includes a pair of rotatable first and second single piece auger devices 70, 72, which are mounted side-by-side and parallel to each other within the first and second recessed sections 68, 69 respectively for moving, mixing and thereby triboelectrically charging the developer material D. The center to center distance between the recesses 68, 69 is substantially equal to the radius of one of the auger devices 70, 72 plus a clearance of 0.020 to 0.050 of an inch. As mounted, the auger devices 70, 72 are counter rotated as shown synchronously, and therefore additionally function to move the charged developer material D upwards from the sump portion 66 into transfer relationship with the feed roller 56. The auger devices 70, 72 also serve to remix spent developer removed from the surface of the development roller 50 by the skive 64.

Figures 3, 4:
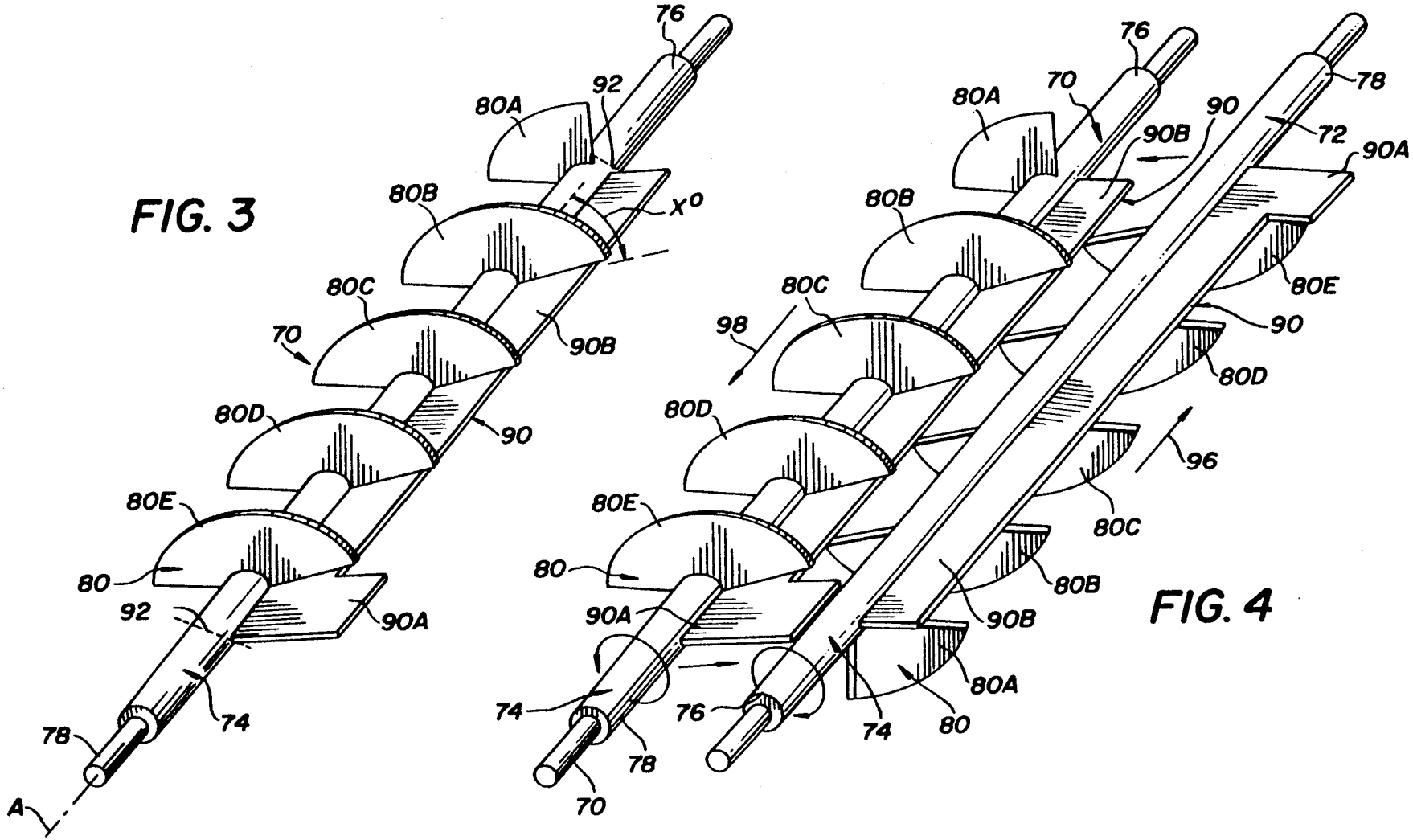
FIG. 3 is a perspective illustration of the single piece auger device of the present invention.
FIG. 4 is a perspective illustration of first and second single piece auger devices, of the present invention in a dual intermeshing auger mixing arrangement.

Referring now to FIG. 3, one of the single piece auger devices, for example the first one 70 thereof (FIG. 2) is illustrated in detail. Since both the first and second auger devices 70, 72 are identical structurally, only one of them (the first one 70) will be described here in detail. As shown, the single piece auger device 70 comprises a rigid round shaft 74, which is made for example of zinc, aluminum or magnesium, or of a thermoplastic material. The single piece auger device 70 has first and second ends 76, 78 each suitable for mounting in an end wall of the development housing 46. The shaft 74 as formed may be hollow so as to be suitable for use with a metallic solid insert therethrough for additional support.

The auger device 70 also comprises a plurality 80 of radially extending blade members shown as 80A, 80B, 80C, 80D, and 80E for moving developer material in a generally axial or longitudinal direction relative to the shaft 74. The actual number of blade members is of course dependent on the spacing pitch thereof, and on the overall length of each auger device itself. In order to increase the reliability of the auger device 70, the plurality 80 of blade members may be formed, that is molded or die casted integrally as one piece with the shaft 74 so as to require no blade-member-to-shaft assembly. As such, the likelihood of part or component failure due to part-to-part assembly or jointing is substantially eliminated. The blades 80A, 80B, 80C, 80D, and 80E are accordingly made from the same material as the shaft 74. The single piece auger device, as such, can be formed for example by any one of a number of well known molding processes including casting.

Still referring to FIG. 3, the blade members 80A, 80B, 80C, 80D and 80E form a single longitudinally or axially extending row on the shaft 74. The row, as shown, is straight and is aligned circumferentially with respect to the shaft 74. Each blade member 80A to 80E is flat and is formed slantingly at a developer material moving attack angle X° of less than 90° with respect to the longitudinal axis A of the shaft 74. The angle X° preferably should be in the range of 30° to 60°. The plurality 80 of the blade members are spaced axially at half pitch, and includes a first blade member shown as 80A which has a wall scraping edge and which is formed adjacent the first end 76 of the shaft 74. The scraping edge thereof is substantially perpendicular to the axis A of the shaft, and is thus suitable for effectively scraping an end wall of the development apparatus 30. The plurality 80 of blade members also has a last blade member shown as 80E which is formed at the very end of the row of blade members towards the second end 78 of shaft 74.

Each blade member 80A to 80E is formed as a stemless semi-elliptical sector that has an inside arc and an outer arc. The inside arc therefore is formed without a stem, and is connected directly to the shaft 74 for preventing what can otherwise be a dead region of developer material immediately adjacent the circumference of the shaft 74 as can happen in the case of blade members that are mounted on stems or posts. The inside arc, extends slantingly a distance that is significantly less than 180° about the circumference of the shaft 74. The outer arc fans out, and as connected to the inner arc follows the slant thereof, and thus has a radius of curvature that is relatively greater than that of the inner arc. As a consequence, the row of blade members 80A to 80E extends transversely and substantially across the shaft 74 in a manner simulating part of a helix.

Referring to FIGS. 2–4, each single piece auger device 70, 72 further includes a cross-mixing vane 90 for moving developer material in a radial direction with respect to the shaft 74. The cross-mixing vane 90 is formed of the same material as, and integrally molded with, the shaft 74. As shown clearly in FIGS. 2–4, cross-mixing vane 90 is a long flat and radially extending member that runs continuously from the first end to the second end, and includes a short first length portion 90A which is radially coextensive for example with the last blade member 80E. The short length portion 90A preferably extends a distance of 0.25 to 0.50 of an inch axially or longitudinally (relative to the shaft 74) from the wall mounting point 92 of the second end 78 of the shaft towards the first end 76. The point 92, for example, is where the inside of a development apparatus end wall would be aligned on the shaft 74 when the auger device 70 is mounted within such development apparatus.

As further shown, the cross-mixing vane 90 also includes a long second length portion 90B which is stepped from the first length portion 90A so as to have a radial extension that is significantly less than that of the first length portion 90A, and hence less than that of the blade members 80A–80E. This difference in the radial extensions of the length portions 90A, 90B allows for differential and increased cross-over movement of developer material at the ends where the portion 90A is located. In order to prevent any stagnant pockets of developer material between the vane 90 and the blade members 80A–80E, the vane 90 is formed spaced circumferentially at an angle-, of Y° (FIG. 2) from the edges of the single row of blade members. Furthermore, in order to prevent interference with the intermeshing blades of an adjacently mounted auger, the vane 90 is formed spaced circumferentially from, but immediately adjacent one of the edges of the single row of blade members, as shown in FIG. 2.

Formed as such, the cross-mixing vane 90 of each auger effectively functions to provide controlled and continuous transfer of developer material from a longitudinal direction over to a radial direction of the shaft 74, thus significantly increasing the mixing and charging of such developer material as it is also moved longitudinally by the blade members 80A-80E.

Referring now to FIGS. 2 and 4, the first and second single piece auger devices 70, 72 are shown in an intermeshing auger arrangement or mode, as shown in FIG. 2. The augers 70, 72 are mounted in the parallel recessed sections 68, 69 of the sump portion 66 of a development apparatus 30. As shown, the first and second auger devices 70, 72, respectively are mounted oppositely with respect to the first and second ends 76, 78 thereof, and approximately 180° out of phase, within the development apparatus housing 46 (FIG. 2). As mounted oppositely, the first shaft end 76 of the first auger device 70 is to the front end (that is, to the left of FIG. 4) of a development apparatus housing, and the second shaft end 78 thereof is to the back end (that is, to the right of FIG. 4) of such a housing. The second auger device 72 as shown is mounted oppositely relative to the first auger device 70 with respect to such front and back ends of such housing.

The auger devices 70, 72 however are mounted such that the blade members of the one auger device are staggered axially with respect to those of the other auger device so as to avoid interference of such blade members when in an intermeshing or interleaving arrangement. The cross-mixing vane 90 of each auger is spaced an angle Y° circumferentially from the nearest edges of the blade members 80A–80E, and extends full length from the mounting point 92 of the first end to that of the second end of the shaft 74. The augers 70, 72 are mounted such that the short first length portion 90 is located at the end towards which developer material is being longitudinally moved along the shaft 74. The 180° out-of-phase mounting means that (as shown) when the row of blade members 80A to 80E of the first auger device 70 are within the top half of the sump section 68, the row of blade members 80A to 80E of the second auger device 72 (running in the opposite direction) will be within the bottom half of the adjacent sump section 69, and vice versa.

As mounted and rotated, the first auger device 70 will move developer material in an axial or longitudinal right-to-left (FIG. 4) direction from the first shaft end 76 thereof towards the second shaft end 78 as shown by the arrow 98 (FIG. 4). In FIG. 2, such movement will be into the plane of the sheet. At the same time, the second auger device 72 will similarly move developer material in the opposite direction as shown for example by the arrow 96 (FIG. 4).

The size of the blade members 80A to 80E of the auger devices 70, 72 are such that as mounted within the sump overlapping sections 68, 69, the staggered blade members 80A to 80E of the one device will significantly interleave with those of the other device. Such interleaving given the 180° out-of-phase arrangement, and the differential cross-transfer back and forth of developer material by the stepped vane portions 90B, 90A results additionally in vastly improved side-to-side movement, shearing and mixing of the developer material. This is because when the blade members of the first auger device 70 are at the bottom (FIG. 4) for example of sump section 68, and are interleaving upwards therefrom, they are doing so through developer material which has been moved there cross-wise by the vane 90 of the other auger 72. The result is substantial cross or side-to-side shearing and mixing into such developer material. Accordingly, the intermeshing single piece auger devices 70, 72 are effectively suitable for producing end to end axial developer material shearing and flow within the sump sections 68, 69. Additionally, they produce desired differential crosswise back-and-forth side-to-side shearing and mixing both at the end walls and midway between such ends. Additionally, the auger devices 70, 72 produce continuous on-center upward feeding movement of developer material due in part to a centrifugal action from such rotating auger devices.

As can be seen, a single piece auger device which can be formed from a single material such as plastic is provided with a mountable round shaft and a single straight row of semi-elliptical partial-blade members that are formed integrally (for example as by molding) with the shaft so that the inner portion of each blade member is coextensive with an elliptical segment on the respective shaft it is formed on. The blade members of each auger device are stemless and are each slanted for moving developer material longitudinally from a first end to a second end of the auger device. Each device includes a cross-transfer or mixing vane which is integrally formed with the shaft and which runs the entire length portion of the shaft locatable within the housing of the development apparatus 30.

The development apparatus of the present invention includes first and second such auger devices mounted oppositely in an interleaving arrangement in the sump portion of such a development apparatus for providing significant circumferentially movement of developer material in a longitudinal direction as well as substantial longitudinal and radial shearing and mixing of such developer material. As a consequence, the development apparatus of the present invention is substantially reliable and provides significantly improved developer material movement, mixing and charging. It effectively prevents dead spots, uneven depletion of toner particles, and uneven accumulation of developer material therein. The net result is improved image development quality.

The invention has been described in detail with particular reference to a presently preferred embodiment, but it will be understood that variations and modifications can be effected within the spirit and scope of the invention.

What is claimed is:

1. A single piece auger device for use in a development apparatus of an electrostatographic reproduction machine to move, mix and triboelectrically charge developer material, the single piece auger device comprising:

(a) a shaft having a first end and a second end for mounting in a development apparatus housing;

(b) a plurality of partial elliptic blade members forming a single circumferentially aligned row thereof for moving developer material longitudinally relative to said shaft; and (c) a cross-mixing vane for moving developer material radially relative to said shaft, said cross-mixing vane extending continuously the full length of said shaft within the development apparatus housing, and said mixing vane having a first length portion having a radial extension coextensive with that of said blade members, and a second length portion having a radial extension less than that of said first length portion, thereby providing for different rates of cross-mixing along said first and second length portions.

2. The single piece auger device of claim 1 wherein each of said partial blade members as formed on said shaft extends circumferentially an angle significantly less than 180°.

3. The single piece auger device of claim 2 wherein said full-length cross-mixing vane is formed circumferentially spaced from one of the edges of said row of blade members.

4. The single piece auger device of claim 3 wherein said cross-mixing vane is formed immediately adjacent one of the edges of said row of blade members.

5. In an electrostatographic reproduction machine, a development apparatus for developing latent images on an image-bearing member using developer material, the development apparatus including:

(a) an elongate housing having first and second sides, a front end, a back end, and a sump portion for holding, mixing and charging developer material, said sump portion including first and second recessed sections, said first and second recessed sections partially forming an overlapping segment therebetween;

(b) a development roller located so as to be adjacent the image-bearing member for moving charged developer material into applying relationship with electrostatic latent images on such image-bearing member;

(c) feed means between said sump portion and said development roller for feeding charged developer material from said sump portion to said development roller; and (d) rotatable first and second single piece auger devices each mounted respectively in said first and second recessed sections of said sump for moving developer material therein, each said single piece auger device comprising:

(i) a shaft having a first end and a second end for mounting in a development apparatus housing;

(ii) a plurality of partial blade members forming a single circumferentially aligned row thereof for moving developer material longitudinally relative to said shaft; and (iii) a cross-mixing vane for moving developer material radially relative to said shaft, said cross-mixing vane extending continuously the full length of said shaft within the development apparatus housing, and said mixing vane having a first length portion having a radial extension coextensive with that of said blade members, and a second length portion having a radial extension less than that of said first length portion, thereby providing for different rates of cross-mixing along said first and second length portions.

6. The development apparatus of claim 5 wherein said first length portion of said cross-mixing vane having a radial extension coextensive with that of said blade members is mounted to an end of said development housing towards which developer material is to be moved.

* * * * *